US005327756A

United States Patent [19]

Fox

[11] Patent Number: 5,327,756

[45] Date of Patent: Jul. 12, 1994

[54] METHOD AND APPARATUS FOR FORMING SPIRAL GROOVES INTERNALLY IN METAL TUBING

[76] Inventor: Francis J. Fox, 2145 Corporation Blvd., Naples, Fla. 33942

[21] Appl. No.: 815,031

[22] Filed: Dec. 31, 1991

[51] Int. Cl.[5] ..... B21B 15/00; B21B 13/20

[52] U.S. Cl. ..... 72/77; 72/68

[58] Field of Search ..... 72/68, 77, 283

[56] References Cited

U.S. PATENT DOCUMENTS

| | | | |
|---|---|---|---|
| 4,646,548 | 3/1987 | Zimmerli et al. | 72/68 |
| 4,854,148 | 8/1989 | Mayer | 72/68 |
| 4,876,869 | 10/1989 | Saeki et al. | 72/68 |
| 4,942,751 | 7/1990 | Fuchs, Jr. | 72/68 |

FOREIGN PATENT DOCUMENTS

| | | | |
|---|---|---|---|
| 109133 | 8/1981 | Japan | 72/283 |
| 140319 | 6/1986 | Japan | 72/283 |
| 107814 | 5/1987 | Japan | 72/283 |
| 588311 | 5/1977 | Switzerland | 72/283 |
| 1528593 | 12/1989 | U.S.S.R. | 72/283 |

*Primary Examiner*—W. Donald Bray
*Attorney, Agent, or Firm*—William F. Hamrock

[57] ABSTRACT

A spinner means and method for forming spiral grooves on the interior surface of tubing including a groove forming means having a plurality of external spiral teeth which contact the tubing forming the grooves wherein said spiral teeth extend in the forward direction and have a helix angle which continually decreases in the forward direction. The method for forming the spiral grooves subjects the tubing interior surface of the tubing to the spinner means having teeth crests which engage the tubing surface when the tubing is being reduced in diameter using only radial forces acting on the crests of the teeth.

28 Claims, 5 Drawing Sheets

FIG. 3A
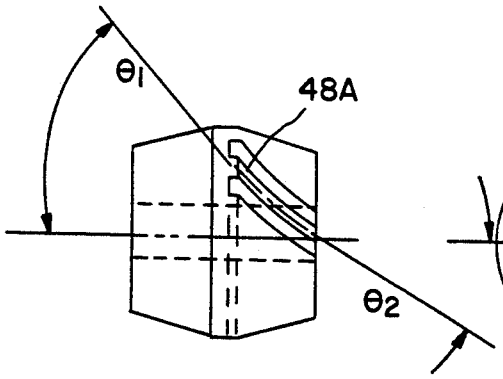
FIG. 3B
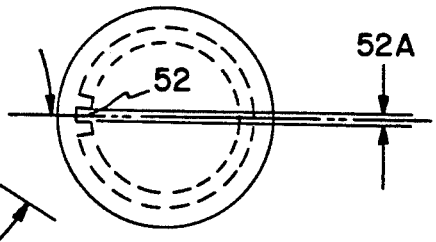
FIG. 5
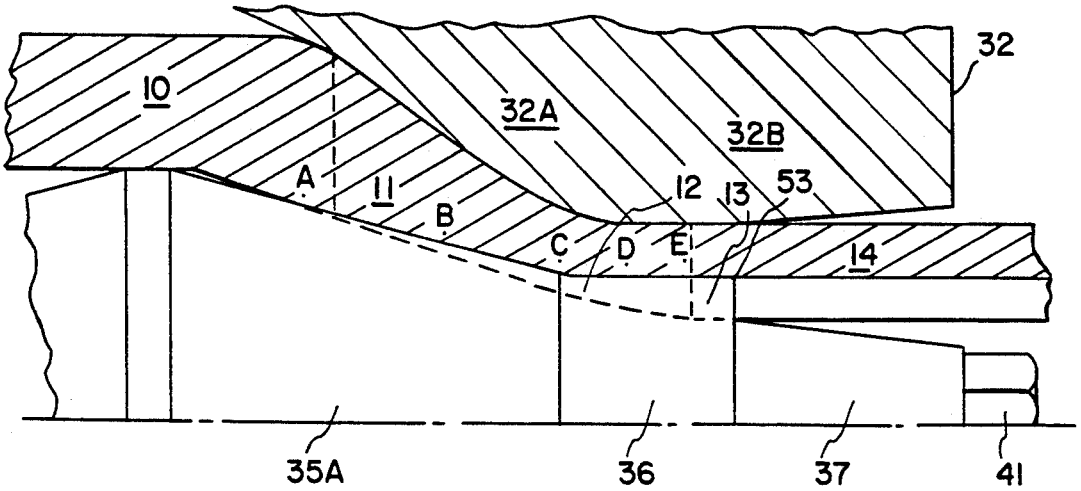
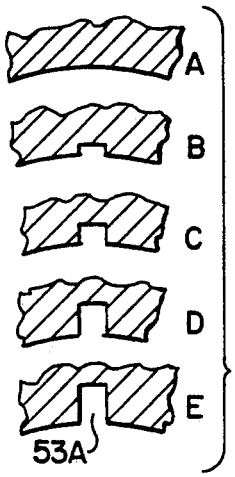
FIG. 5A
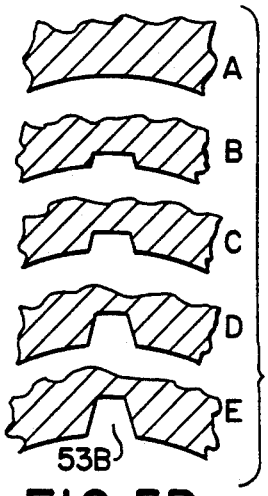
FIG. 5B
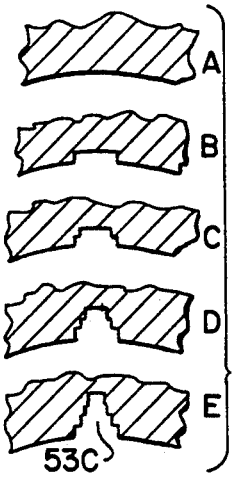
FIG. 5C

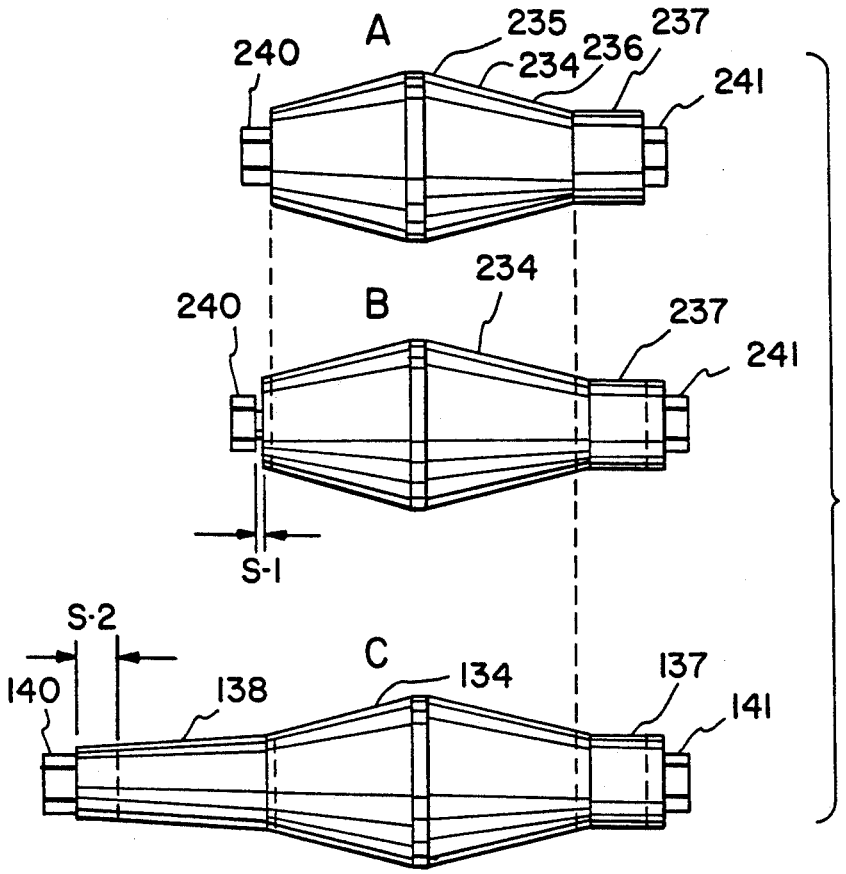
FIG. 7
FIG. 8B
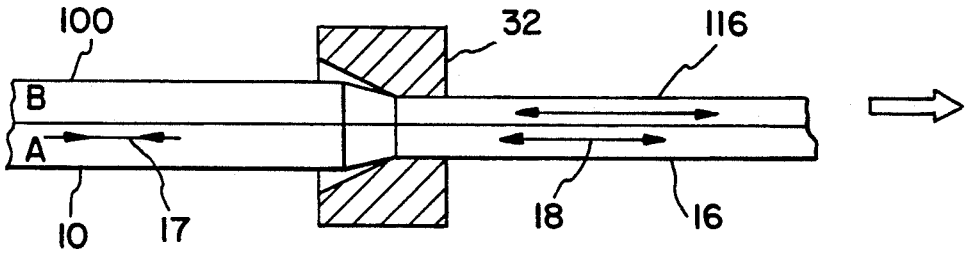

METHOD AND APPARATUS FOR FORMING SPIRAL GROOVES INTERNALLY IN METAL TUBING

BACKGROUND OF THE INVENTION

1. Field of the Invention

This invention generally relates to an improved method and apparatus for forming thin spiral grooves in the inner surface of metal tubing, and more particularly, to an inner grooving process and apparatus for metal tubing which tubing is suitable for heat transfer of a heat exchanger, an air conditioner, a refrigerator, or the like.

2. Description of the Prior Art

Heat exchange tubing, such as copper tubing and the like, used in an air conditioner or a refrigerator, can be provided with internal grooves to enhance the heat transfer characteristics of the tubing. Many methods and apparatus are known for forming grooves on the inside surfaces of the tubing.

Known commercial tube drawing machines and processes of producing inner grooved metal tubing include tube reducing and grooving processes wherein grooves are formed on the inner wall of metal tubing during the processing of the metal tubing after it is reduced in diameter. The inner grooves can be formed by a grooved plug or spinner mounted within the tube. However, particular difficulties have been encountered in providing an efficient method and apparatus for use in commercial drawing machines that will form internal grooves in thin wall metal tubing without rupturing the thin tubing wall.

The present inventor, Francis J. Fox, A.K.A. Francis J. Fuchs, Jr., in his U.S. Pat. Nos. 4,702,960; 4,942,751 and 4,947,669 provided improvements over the prior art in the method and apparatus for forming such internally grooved tubing. The present invention is an improvement over these and other prior art methods and apparatus.

SUMMARY OF THE INVENTION

Accordingly, it is the primary object of the invention to provide a grooving method and spinner whereby grooves are formed within metal tubing in commercial drawing machines without exceeding the tensile strength of the tubing.

Another primary object of the invention is to provide a groove forming spinner which will form deep grooves having decreasing helix angle in the deformation zone ending in constant helix grooves within metal tubing in commercial drawing machines at speeds of up to 4,000 feet per minute.

A further objective of the invention is to provide a spinner which is controlled and reliable in initiating the floating spinner entry into the die.

A further objective is to provide a spinner having a temperature compensation element.

The foregoing objects and other objects of the invention have been achieved in commercial drawing machines at speeds up to 4,000 feet per minute by a method and apparatus which involves first processing the inner surface of metal tubing by drawing the tubing with its inner surface in contact with a roughing spinner-having a plurality of external spiral teeth having a helix angle which decreases in the direction of the drawing thereby producing a plurality of internal spiral grooves with a helix angle continuously decreasing in the direction of the drawing during the period of contact to a constant helix angle; and then reprocessing the drawn tubing by drawing the tubing while its inner grooved surface is in contact with a smaller finishing spinner having a plurality of external spiral teeth having a helix angle which decreases in the direction of the drawing thereby increasing the depth of the plurality of internal spiral grooves previously formed to an increased depth greater than that obtained from the first drawing and having a constant helix angle smaller than that obtained from the first drawing.

BRIEF DESCRIPTION OF THE DRAWINGS

In the accompanying drawings:

FIGS. 3, 3A and B are schematic illustrations showing the principle of decreasing helix angle with respect to the spinner taper segment.

FIG. 5 is a schematic illustration of the progressive indentation in the tubing by the spinner plug assembly.

FIG. 5A, B and C are schematic illustrations of the progressive indentation of various groove shapes that can be formed by the spinner plug assembly.

FIGS. 7A, B and C are schematic comparative views showing the effect of temperature compensation spacer.

DETAILED DESCRIPTION OF THE PREFERRED EMBODIMENTS

Figure 1:
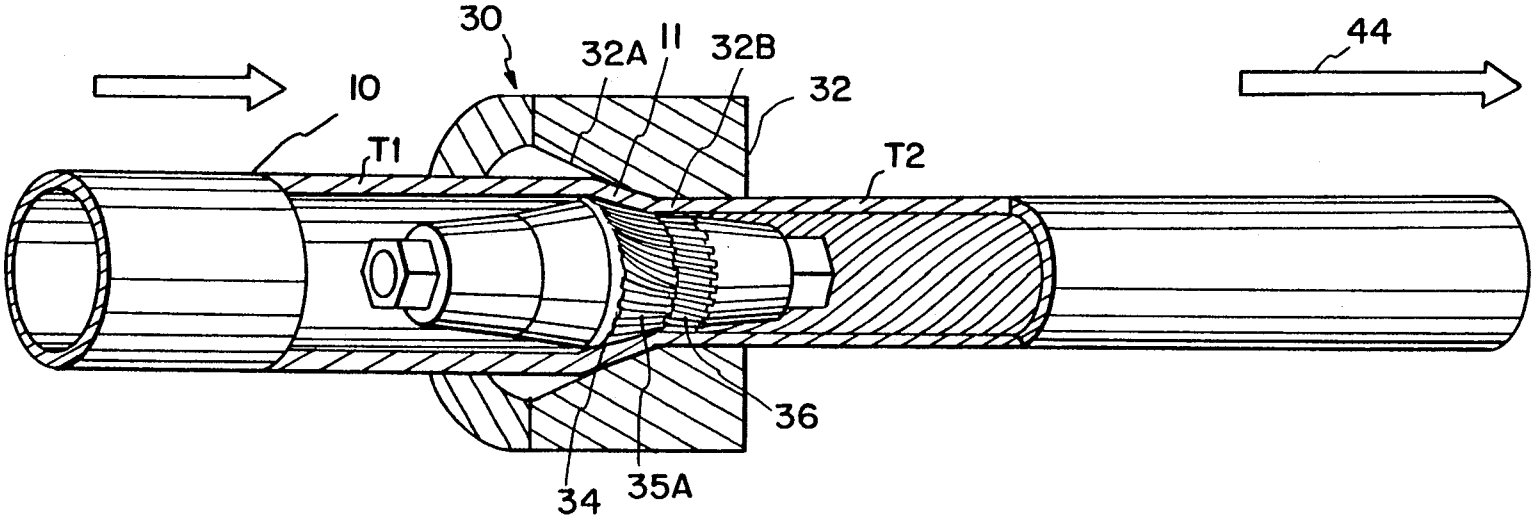
FIG. 1 is a sectional view of the apparatus which is used to practice the grooving process of the invention.
Figure 2:
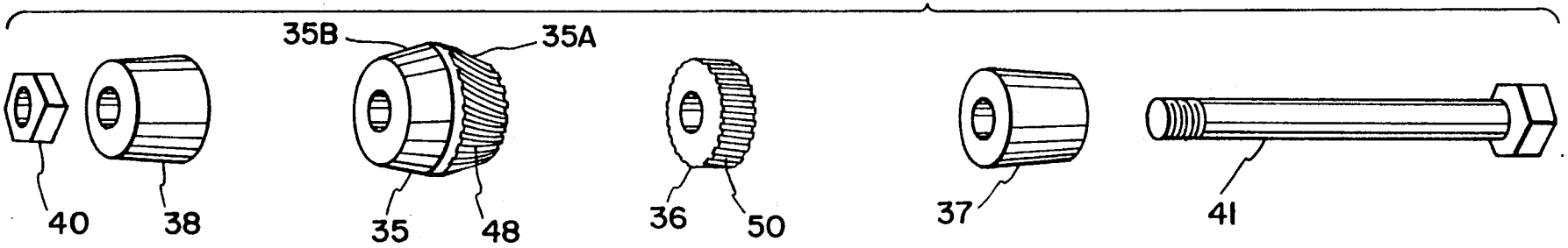
FIG. 2 is an exploded view of the spinner plug assembly.

FIGS. 1 and 2 illustrate apparatus 30 in accordance with the present invention for grooving the inner surface of metal tubing 10. Apparatus 30 includes a draw die 32 and a spinner 34. In one embodiment of the present grooving operation, metal tubing 10 is drawn between draw die 32 and spinner 34 by a drawing means, not shown, such as draw blocks, which applies tensioned force on the tubing in the forward direction to move tubing 10 in the direction of arrow 44.

Spinner 34, as shown in FIG. 2, includes spinner taper section 35, spinner pilot section 36, pull-in bushing 37 and temperature compensating spacer 38 which are mounted on headed bolt 41 and threadly secured by nut 40. All component parts of spinner 34 are aligned and secured so that entire spinner 34 will rotate as a unit without inbetween movement of any of its component parts during the grooving operation. Spinner taper section 35 is mounted and aligned between spinner pilot 36 and temperature compensating spacer 38, Spinner taper section 35 includes spinner taper segment 35A tapering downwardly in the forward direction which is integral with smooth surfaced conical rear segment 35B tapering slightly downwardly in the rearward direction. Spinner taper segment 35A has a plurality of radially outwardly extending external spiral teeth 48 having a helix angle which decreases in the forward direction.

Spinner pilot section 36 is mounted and aligned between spinner taper section 35 and pull-in bushing 37. Spinner pilot section 36 has an annular shaped structure and tapering slightly downwardly about 2–3 degrees in the forward direction having a plurality of radially outwardly extending external spiral teeth 50 having a width less than taper section teeth 48 and having a decreasing helix angle which is continually decreasingly smaller helix angle than the spinner taper section final helix angle. Spinner pilot section 36 is structurally configured and aligned with spinner taper section 35 so as to produce the proper tooth pattern of decreasingly varying helix angle which is a most critical element of the invention.

Pull-in bushing 37 is mounted and aligned in front of spinner pilot section 36 and is in secured engagement with headed bolt 41. Pull-in bushing 37 has an annular structure having slightly forward taper of about 1 degree to 3 degrees and has an exterior smooth surface.

Temperature compensating spacer 38 is mounted and aligned rearwardly to spinner tapered section 35 and is in secured engagement with nut 40. Spacer 38 has a slightly rearwardly tapered conical structure with a smooth exterior surface.

In accordance with the, preferred embodiment, there are two processing operations Of the invention. The first processing operation is referred to as the ready to finish taper and pilot procedure or the roughing procedure which employs the ready to finish spinner or roughing spinner. The second operation is the finished taper and pilot procedure or the finishing procedure which employs the finishing spinner. The roughing spinner and the finishing spinner are practically identical except that the finishing spinner is smaller than the roughing spinner and is structurally configured to align with and increase the depth of the grooves formed by roughing spinner and having continually decreasing helix angle to a constant helix angle.

In the roughing procedure as depicted in FIGS. 1 and 5, tubing 10 to be processed is shown having a wall thickness TI and including internal portions 12 and 13 into which spiral grooves are formed.

Figure 6A:
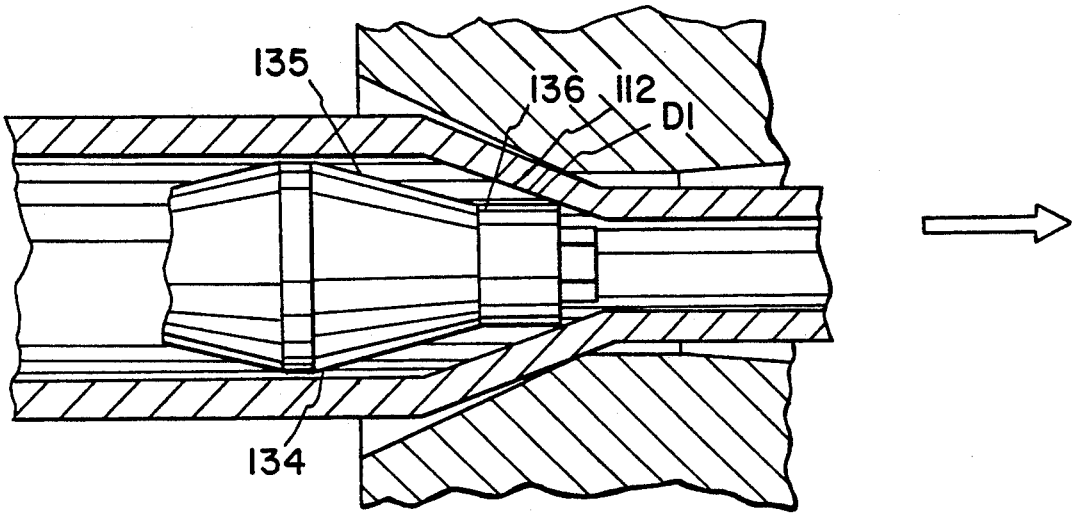
FIGS. 6A and B are schematic comparative views of the effect of the spinner plug with and without a pull-in bushing.
Figure 6B:
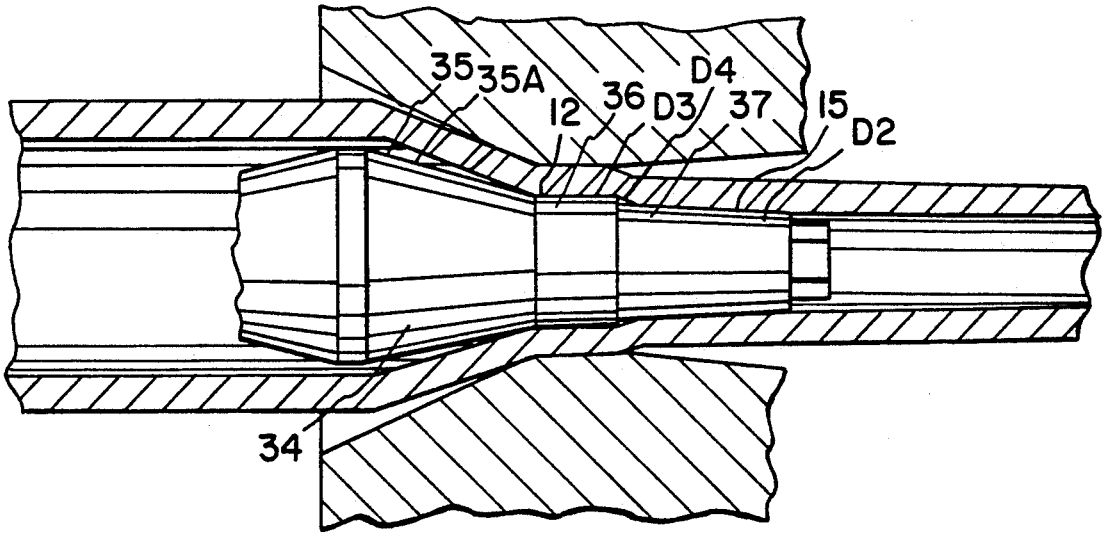

FIGS. 6A and 6B are directed to comparative examples of the initial phase of the process which involves the pull-in spinner phase embodiment of the invention. FIG. 6A depicts a spinner 134 having taper and pilot sections but does not conform to the present invention since a pull-in bushing is not present. As shown therein, the front edge of pilot section 136 then encounters the interior wall 112 of the tubing where the sinking tube diameter D-1 of the tubing produces a steep angle and prevents spinner sections 135 and 136 from coming in contact with the interior wall 112 of the tubing.

In comparison thereto and in accordance with the present invention as shown in FIG. 6B, pull-in bushing 37 is present in spinner 34 and has a smaller diameter D-2 than diameter D-3 of spinner pilot section 36 and thereby initially locks into interior 15 of the tubing. Spinner 34 is then pulled into place bringing spinner pilot section 36 and tapered spinner segment 35A into engaged contact with the interior of the tubing. Spinner pilot section 36 being in engaged contact with the interior 12 of the tubing is then able to maintain the enlarged interior diameter D-4 of the tubing while forming grooves therein and allowing the enlarged D-4 diameter tubing to clear the pull-in plug during the subsequent drawing operation.

As shown in FIGS. 1 and 5, tubing 10 is moved in the forward direction indicated by arrow 44 wherein the diameter of the tubing and its wall thickness are reduced, Upon such movement, the tubing is advanced between the conical portion 32A and annular 32B portion of draw die 32 and the conical taper spinner segment 35A and annular spinner pilot section 36 of spinner 34 to reduce the outer diameter and wall thickness of the tubing while pulling and maintaining spinner 34 in place as seen in FIG. 1. During such movement, stretched tubing interiors 11,12 and 13 engage external spiral teeth 48 of spinner taper segment 35A and external spiral teeth 50 of spinner pilot section 36 which imparts rotation to spinner 34 while forming grooves 52 in the tubing as illustrated in FIG. 5.

Figure 4A:
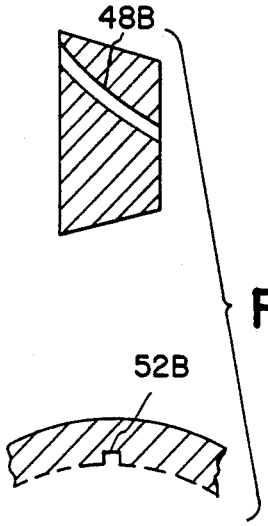
FIGS. 4A, B and C are schematic illustrations of the various groove shapes that can be formed by the spinner taper segment.

Grooves 52 illustrated in FIG. 3B, and grooves 52B, C and D illustrated in FIGS. 4A, B and C are initially pressed into the interior of the stretched tubing by spinner segment 35A having an initial helix angle and said grooves are stretched out over a longer length to exit tapered draw portion 32A with a smaller helix angle. Upon engaging annular draw die portion 32B said grooves are pressed deeper by spinner pilot section 36 and said smaller helix angle is further decreased to exit the annular draw die portion 32B with a smaller helix angle which becomes constant at its exit portion 13.

The principle of varying helix angle which is the essence of the invention is illustrated in FIGS. 3–5. As previously discussed, external spiral teeth 48 of conical spinner taper segment 35A are angularly displaced with respect to each other having decreasing helix angle and having grooves inbetween said teeth. Also, external spiral teeth 50 of annular spinner pilot section 36 are angularly displaced with respect to each other having further decreasing helix angle smaller than that of teeth 48 and having grooves inbetween these teeth. As the tubing is reduced in diameter and wall thickness by draw die 32, grooves 52, 52B, C and D pressed into the tubing interior with an initial helix angle are stretched out over a long length of the stretched tubing and exit draw die 32 with a decreased helix angle. If the teeth patterns of spinner taper segment 35A and spinner pilot section 36 do not match this change, the tubing interior metal flow will experience side binding on teeth 48 and 50 and the draw force will go up greatly. In accordance with the present invention, when the aligned teeth patterns are correct, using only radial forces acting on the crests of the teeth to form spiral grooves, it allows the tubing interior metal to flow along the exact path of the crests of teeth 48 and 50 even though the reduction of the tubing stretched portions cross-section causes a speed-up of the draw rate.

The depth of the grooves 52, 52B, C and D being formed by taper teeth 48 and the increased depth of these grooves being formed by pilot teeth 50 are mutually self-controlling and self-balancing thereby preventing disengagement of spinner 34 from contact with tubing interior 11,12 and 13. This critical self-controlling and self-balancing feature of spinner 34 not only prevents said disengagement but also prevents side binding on the teeth due to uncontrolled metal flow as well as preventing breakage of the tubing. Shown in FIG. 3A is an illustration of a tapered tooth having a square tooth cross-section such as a tooth 48 of spinner taper segment 35A, and having an initial helix angle $\theta 1$ and an exit smaller helix angle $\theta 2$. As seen, entrance helix angle 1 decreases to exit helix angle $\theta 2$ while forming a parallel sides 52A shaped groove, such as groove 52, in the tubing as shown in FIG. 3B. It is because of this tooth pattern and square tooth cross-section that only the crest 48A of the tooth is in contact with the interior tubing using only radial forces acting on the crests of the teeth to form spiral grooves allowing the tubing to flow along the exact path of the spinner tooth crest preventing side binding on the spinner teeth.

Figure 4B:
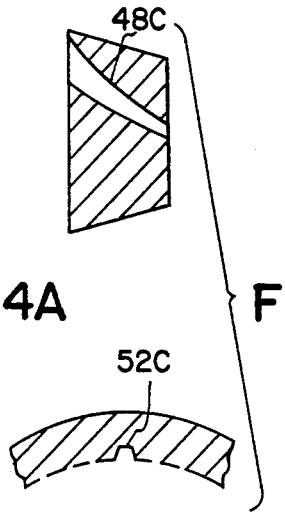
Figure 4C:
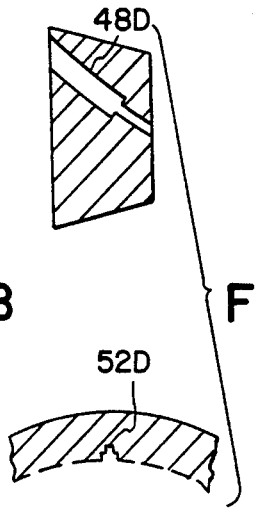

FIGS. 4A, B and C are illustrations of the various types of grooves, such as grooves 52B, C and D, that can be formed by the spinner taper segment 35A in the interior wall of the tubing. FIG. 4A indicates a taper spinner segment wherein the crest 48B of each tooth has parallel sides resulting in forming rectangular shaped grooves 52B in the tubing. FIG. 4B indicates a spinner taper segment wherein crest 48C of each tooth has inwardly tapering sides resulting in forming grooves 52C with inwardly tapering side walls resembling a trapezoid. FIG. 4C indicates a taper spinner segment wherein the crest 48D of each tooth has two sections with parallel sides in sequence whereby the second or sequential section is smaller than the first or initial section thereby forming two rectangular shaped grooves or stepped grooves 52D.

FIG. 5 is an illustration of the extent of progressive tooth indentation pressed into the tubing in accordance with the first process embodiment of the invention. Illustrated therein are the depths of indentation at points A,B,C,D and E of tubing interiors 11,12 and 13 initially with spinner taper segment 35A and then with spinner pilot section 36. As the tubing is being stretched and advanced forward, it initially engages the crests of the spinner taper segment teeth at about point A to initiate forming progressively deeper continuous grooves such as said grooves 52B, C and D in tubing portion 11 as shown at points B and C. At about point C, the tubing stretched portion engages the crests of the spinner pilot section teeth to continue forming progressively deeper continuous grooves in tubing interior 12 as shown at points D and E. At point E, the depth of the grooves and the helix angle become constant and the reduced thickness of the tubing, designated as tubing 14, becomes constant.

Illustrated in FIGS. 5A, 5B and 5C are sketches showing in greater detail the progressive indentation of copper tubing by the spinner teeth in accordance with the first or roughing procedure of the invention. Shown therein are tubing sections A, B, C, D and E depicting 3 formed shapes of groove indentions similar to the groove shapes initially formed by the spinner taper segments of FIGS. 4A, B and C and to the groove depths at points A, B, C, D and E of FIG. 5.

Tubing sections A, B and C of FIGS. 5A, 5B and 5C depict the continuous progressive groove indentations formed by engaging the crests, such as 48A, crests of the teeth of the spinner taper segment. Tubing sections D and E depict the continuous progressive groove indentations formed by engaging the crests of the teeth of the spinner pilot section with the tubing indentation subsequent to the spinner taper segment indentation.

The above described first procedure or roughing procedure is continued until the internal portion 13 of the tubing has a plurality of internal spiral grooves along its interior length such as grooves 53A, B and C in accordance with the invention to await the second procedure or finishing procedure. The spinner for the finishing procedure is identical to spinner 34 of the first procedure except it has a slightly smaller diameter to accomplish the finishing operation of the tubing and the teeth in the spinner taper section and in the spinner pilot segment extend deeper to accommodate the roughed in grooves from the first procedure or roughing procedure.

An important feature of the invention is the functioning of temperature compensation spacer 38 in spinner 34 during the drawing operation. It is imperative that the spinner taper teeth and spinner pilot teeth be in exact alignment at all times to maintain the correct teeth pattern. It is particularly a problem when the spinner becomes hot from the friction during the drawing operation causing the metal components to expand and to loosen nut 40 and bolt 41 and also the mounted spinner taper section 35 and spinner pilot section 36.

The temperature compensation spacer 38 embodiment of the invention solves the above problems by equalizing the differences in coefficient of expansion of the metal components of spinner 34 as shown in FIG. 7. FIG. 7A represents an example of a spinner 234 at room temperature composed of metal components taper section 235, pilot section 236, pull-in bushing 237 which are made of tungston carbride metal and nut 40 and bolt 41 made of steel similar to the structure of spinner 34 except that there is no temperature compensation spacer. FIG. 7B represents an example of how the difference of tungston carbide expansion and the steel bolt expansion of spinner 234 at elevated temperatures results in expansion space S-1. FIG. 7C represents an example of a spinner 134 composed of metal components including compensation spacer 138 made of beryllium copper similar to the structure of spinner 34 and shows how the high coefficient of thermal expansion of the beryllium copper in temperature compensation spacer 138 is used to keep the bolt from loosening when the spinner plug assembly 134 becomes hot from friction by compensating for the probable expansion S-2. By equalizing the differences in the thermal coefficient of expansion of the metal components, the pull-in bushing, spinner pilot section, spinner taper section, temperature compensation spacer, bolt and nut are compressively secured together as a unit so that there is aligned unified rotation thereof without intermediate individual movement therebetween during the grooving process. This is an important embodiment of the invention because the pilot teeth and the taper teeth are then held in exact alignment at all times to produce the required spiral grooves.

The following formula is used to determine the compensation for the differences in the thermal coefficient of expansion of the tungston carbide (pull-in bushing, spinner pilot section and spinner taper section), the steel bolt and nut, and the beryllium copper (temperature compensation spacer):

Where: Ls is length of steel,
Cs is coefficient of expansion of steel,
Ltc is length of tungston carbide,
Ctc is coefficient of expansion of tungston carbide,
Lbc is length is beryllium copper,
Cbc is coefficient of expansion of beryllium copper.

Formula: $Ls \times Cs - Ltc \times Ctc \leqq Lbc \times Cbc$.

Figure 8A:
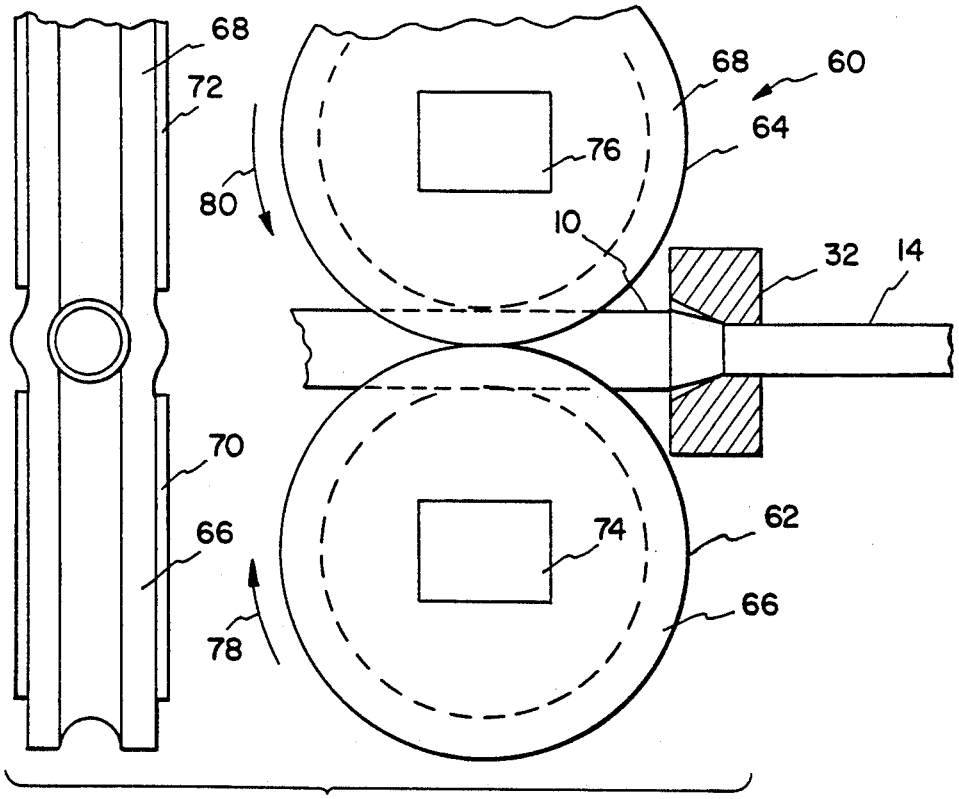
FIGS. 8A and B are schematic views showing the effect of a compression feeding.

A further preferred embodiment of the invention is shown in FIG. 8A which is directed to the compression feeding mechanism for advancing the tubing in the forward direction into the die. Referring to FIG. 8A, there is illustrated compression feeding apparatus 60 which includes the association of a pair of rotating rolls 62 and 64 for the purpose of applying a compressive force therebetween to tubing 10 thereby advancing it forward into die 32.

Rolls 62 and 64 have elastomeric grooved wheels 66 and 68 covered by steel side plates 70 and 72. The rolls are driven by hydraulic motors 74 and 76 in the direction of the arrows 78 and 80. During the compressive movement of tubing 10 between the rolls 62 and 64 through draw die 32 in the forward direction, the grooved tubing portion 14 is pulled forward, by a draw block not shown, subjecting the tubing 14 to tensile stress which is lessened and semi-equalized by the compressive forward force exerted on tubing 10 by the rolls. Steel side plates 70 and 72 prevent the elastomeric grooved wheels from bulging and spreading outwardly.

A comparative example is shown in FIG. 8B. In illustration A is a diagram of how applying the compressive force in accordance with compression feeding of the invention to advance the tubing 10 into die 32 reduces the tensile stress prior to entering the die and upon exiting it as grooved tubing 16 as illustrated by arrows 17 and 18. This lessening of tension allows the wall thickness of tubing to remain high and to produce deeper grooves. Shown in the comparative illustration in FIG. 8B in illustration B is an example where no compression force is applied to tubing 100 thereby resulting in increased tension force on the tubing and reducing the wall thickness resulting in shallow grooves in tubing 116.

Having now fully described the invention, it will be apparent to one of ordinary skill in the art that many changes and modifications can be made thereto without departing from the spirit and scope of the invention as set forth herein.

What is claimed is:

1. A method of forming spiral grooves on the interior surface of tubing said grooves having a concluding depth and a concluding helix angle comprising:

subjecting the interior surface of the tubing to spinner means provided with groove forming teeth means having teeth crests which engage the tubing surface when the tubing is being reduced in diameter and using only radial forces acting at the crests of the teeth means to form said spiral grooves by continuously increasing a beginning depth to the concluding depth and continuously decreasing a beginning helix angle to the concluding helix angles.

2. A method according to claim 1 wherein the spinner groove forming means rotatably engages the tubing surface.

3. A method according to claim 2 wherein said radial forces act perpendicular to the tubing surface.

4. A method according to claim 3 wherein said teeth means have vertical sides wherein contact on said sides of the teeth means is substantially eliminated.

5. A method according to claim 4 wherein said groove forming means includes conical tapered spiral teeth means.

6. A method according to claim 5 wherein said groove forming means provide annular spiral teeth means aligned with said tapered spiral teeth means.

7. A method according to claim 6 wherein said annular spiral teeth means provide slightly tapered spiral teeth.

8. A method according to claim 7 wherein said conical teeth means and said annular spiral teeth means are adjacent to each other.

9. A method according to claim 8 wherein said conical spiral teeth means and said annular spiral teeth means are mutually self-controlling and self-balancing.

10. A method according to claim 9 wherein said grooves are formed in metal tubing causing metal to flow.

11. A method according to claim 10 wherein said decreasing helix angles match said flow of metal.

12. A method according to claim 11 wherein said radial forces acting at crests of teeth cause the metal to flow along the path of the crests of teeth of said adjacent conical spiral teeth means and annular spiral teeth means.

13. A method of manufacture of drawing tubing while forming a plurality of internal spiral grooves therein comprising:

drawing the tubing between a first die and a first floating spinner said spinner providing a plurality of external spiral teeth having a helix angle which decreases in the direction of the drawing to a constant helix angle to provide said tubing with a plurality of internal spiral grooves having a first depth and a first concluding helix angle, redrawing said tubing between a smaller second die and a smaller second floating spinner to increase the depth of said plurality of spiral grooves to a deeper second depth and to further decrease said first concluding helix angle to a constant helix angle.

14. A method according to claim 13 wherein the tubing is drawn and/or redrawn between said dies and said floating spinners by being compressively engaged and moved therethrough by an advancing tubing means.

15. A method according to claim 14 wherein said advancing tubing means provides a pair of opposed, rotatable wheels to compressively engage and move the tubing.

16. A method of manufacture of drawing tubing while forming a plurality of internal spiral grooves therein comprising:

providing a draw die providing a passageway extending therethrough and a first floating spinner providing a plurality of external spiral teeth having a beginning helix angle decreasing in the direction of the drawing to a smaller first concluding helix angle, advancing said tubing between said first draw die and said first spinner to reduce said tubing outer diameter and maintain said floating spinner in place to cause said tubing internal portion to contact and impart rotation to said first spinner and cause said external spiral teeth to form a plurality of spiral grooves therein having a first depth and a first concluding helix angle, and provide said tubing with a reduced diameter and a reduced wall thickness, providing a smaller second draw die having a passageway extending therethrough and a smaller second floating spinner provided with a plurality of external spiral teeth having a second beginning helix angle smaller than said first concluding helix angle which second helix angle decreases in the direction of the drawing to a smaller second concluding helix angle, positioning said drawn tubing between said second draw die and said second spinner and aligning said external spiral teeth of said second spinner with said spiral grooves formed in said tubing internal portion by said first spinner and advancing said tubing between said second draw die and said second spinner to further reduce the outer diameter and maintain said second floating spinner in place and cause said second external spiral teeth to increase said first depth of said internal spiral grooves to a deeper second depth, and to further decrease said first concluding helix angle to a constant helix angle.

17. A method according to claim 16 wherein said tubing and/or said drawn tubing is advanced between said draw dies and said spinners by being compressively engaged and moved therethrough by an advancing tubing means.

18. A method according to claim 17 wherein said advancing tubing means provides a pair of opposed, rotatable wheels to compressively engage and move the tubing.

19. A spinner means for forming spiral grooves on the interior surface of tubing comprising a groove forming means having a plurality of external spiral teeth for contacting said tubing to form said grooves, said spiral teeth extending in the foreward direction and having a helix angle which continually decreases in the forward direction.

20. A spinner means according to claim 19 wherein said groove forming means provides conical tapered teeth means with a plurality of spiral teeth tapered in the forward direction.

21. A spinner means according to claim 20 wherein said groove forming means provides forward annular teeth means with a plurality of spiral teeth aligned with said tapered teeth means and tapered slightly in the forward direction.

22. A spinner means according to claim 21 wherein said conical means provides teeth with a first width and said annular means have teeth with a second width which is less than said first width.

23. A spinner means according to claim 22 wherein said helix angle continuously decreases to a constant helix angle in said annular means.

24. A spinner means for increasing the depth of spiral grooves previously formed on the interior surface of the tubing comprising:

a groove forming means having a plurality of external spiral teeth for receiving said previously formed grooves, said spiral teeth having a helix angle which decreases in the direction of the drawing to provide said internal spiral grooves having a deeper depth than said previously formed spiral grooves.

25. A temperature compensation spinner means which may become heated when forming spiral grooves on the interior of metal tubing, said spinner means providing metal means prepared from metals having different coefficients of expansion, said metal means caused to expand when heated while forming said spiral grooves, the higher the coefficient of expansion the greater the expansion of the metal, comprising:

adjacent groove forming metal means and spacer metal means compressively secured and mounted on a support metal means, wherein said groove forming metal means has the lowest coefficient of expansion and the least extent of expansion of all of said means when heated, said support metal means has a higher coefficient of expansion and a greater extent of expansion than said groove forming means when heated, and said spacer metal means has the highest coefficient of expansion and the greatest extent of expansion of all of said metal means when heated, whereupon forming said spiral grooves on said tubing causing said spinner means to become heated, said groove forming means expands the least extent, said support means expands the greater extent, and said spacer means expands the greatest extent causing said groove forming means, spacer means and support means to remain compressively secured and to rotate together as a unit without separate intermediate individual movement therebetween.

26. A spinner means according to claim 25 wherein said groove forming means provides conical tapered spiral teeth means positioned adjacent to said spacer means and annular slightly tapered spiral teeth means positioned adjacent to said conical means.

27. A spinner means according to claim 26 wherein said groove forming metal is tungston carbride, said support metal is steel and said spacer metal is beryllium copper.

28. A spinner means according to claim 27 providing a pull-in bushing means made from tungston carbide metal forwardly adjacent to said annular spiral teeth means.

* * * * *